US009431233B2

(12) United States Patent
Kim et al.

(10) Patent No.: US 9,431,233 B2
(45) Date of Patent: Aug. 30, 2016

(54) PLASMA LIGHTING SYSTEM WITH A METALLIC MATERIAL IN THE BULB

(71) Applicant: LG Electronics Inc., Seoul (KR)

(72) Inventors: Donghun Kim, Seoul (KR); Hyunjung Kim, Seoul (KR); Byeongju Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/335,705

(22) Filed: Jul. 18, 2014

(65) Prior Publication Data

US 2015/0200084 A1 Jul. 16, 2015

(30) Foreign Application Priority Data

Jan. 14, 2014 (KR) ..... 10-2014-0004380

(51) Int. Cl.
*H01J 65/04* (2006.01)
*H01J 61/54* (2006.01)
*H01J 23/15* (2006.01)

(52) U.S. Cl.
CPC ..... *H01J 65/044* (2013.01); *H01J 61/54* (2013.01)

(58) Field of Classification Search
CPC ..... H01J 65/044; H01J 61/54; H01J 25/587; H01J 23/05; H01J 23/15
USPC ..... 315/39.51
See application file for complete search history.

(56) References Cited

U.S. PATENT DOCUMENTS

| | | | | |
|---|---|---|---|---|
| 6,137,237 | A * | 10/2000 | MacLennan | H01J 61/12 313/231.61 |
| 6,734,630 | B1 * | 5/2004 | Choi et al. | 313/638 |
| 6,744,221 | B2 * | 6/2004 | Choi et al. | 315/248 |
| 2003/0057882 | A1 | 3/2003 | Lapatovich | |
| 2006/0250065 | A1 * | 11/2006 | Lee et al. | 313/113 |
| 2008/0315799 | A1 * | 12/2008 | Park et al. | 315/344 |
| 2009/0146587 | A1 * | 6/2009 | Li | 315/501 |
| 2010/0156295 | A1 * | 6/2010 | Park et al. | 315/39 |
| 2012/0262051 | A1 | 10/2012 | Howell et al. | |

FOREIGN PATENT DOCUMENTS

KR 10-2008-0057042 A 6/2008

* cited by examiner

*Primary Examiner* — Dylan White
(74) *Attorney, Agent, or Firm* — Birch, Stewart, Kolasch & Birch, LLP

(57) ABSTRACT

A plasma lighting system includes a magnetron configured to generate microwaves, and a bulb in which a dose for generation of light using the microwaves and at least one metallic material for generation of thermal electrons are received. The metallic material reduces an electric field intensity required for electric discharge by discharging thermal electrons. In this way, the plasma lighting system reduces the time it takes to turn the light back on after the light is turned off.

14 Claims, 4 Drawing Sheets

(a)

(b)

PLASMA LIGHTING SYSTEM WITH A METALLIC MATERIAL IN THE BULB

This application claims the benefit of Korean Patent Application No. 10-2014-0004380, filed on Jan. 14, 2014, which is hereby incorporated by reference as if fully set forth herein.

BACKGROUND OF THE INVENTION

1. Field of the Invention

The present invention relates to a plasma lighting system and more particularly, to a plasma lighting system which may reduce the time it takes to turn the light back on (a light-on condition) after the light is turned off (a light-off condition).

2. Discussion of the Related Art

In general, a lighting system using microwaves (several hundred MHz to several GHz) is designed to generate visible light by applying microwaves to an electrodeless plasma bulb.

The microwave lighting system is an electrodeless discharge lamp in which a quartz bulb having no electrode is filled with inert gas.

Recently, the microwave lighting system is configured to emit a continuous spectrum in a visible light range via high voltage electric discharge of sulfur. The microwave lighting system is also referred to as a plasma lighting system.

In the plasma lighting system, the interior of the bulb remains in a high pressure state immediately after a light-off condition. Accordingly, electric discharge does not occur and a light-on condition cannot be implemented again until the internal pressure of the bulb falls below a given level via cooling after a light-off condition.

That is, much time is needed until a light-on condition can be obtained immediately after a light-off condition, which makes it difficult to instantly cope with an unexpected situation, etc.

SUMMARY OF THE INVENTION

Accordingly, the present invention is directed to a plasma lighting system that substantially obviates one or more problems due to limitations and disadvantages of the related art.

One object of the present invention is to provide a plasma lighting system which may reduce time taken until a light-on condition can be achieved after a light-off condition.

Another object of the present invention is to provide a plasma lighting system which may cause electric discharge even in a state in which the interior of a bulb remains in a high pressure state, thereby enabling a relatively instantaneous light-on condition.

Another object of the present invention is to provide a plasma lighting system which may allow an electric field in the interior of a bulb to be concentrated on a metallic material, thereby achieving an electric field intensity required for electric discharge.

A further object of the present invention is to provide a plasma lighting system which may achieve a luminous flux of a given level or more and maintain a desired luminous efficacy.

To achieve these objects and other advantages and in accordance with the purpose of the invention, as embodied and broadly described herein, a plasma lighting system includes a magnetron configured to generate microwaves, and a bulb in which a dose for generation of light under the influence of the microwaves and at least one metallic material for generation of thermal electrons are received.

The metallic material may include at least one selected from the group consisting of tungsten (W), tantalum (Ta), molybdenum (Mo), rhenium (Re), lanthanum hexaboride ($LaB_6$) and cerium hexaboride ($CeB_6$).

The metallic material may be surrounded by an insulation capsule.

The insulation capsule may be formed of quartz or ceramic.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, a plasma lighting system according to one embodiment of the present invention will be described in detail with reference to the accompanying drawings.

The accompanying drawings show an exemplary configuration of the present invention and are merely provided to describe the present invention in detail, and the scope of the present invention is not limited by the accompanying drawings and the detailed description thereof.

Figure 1:
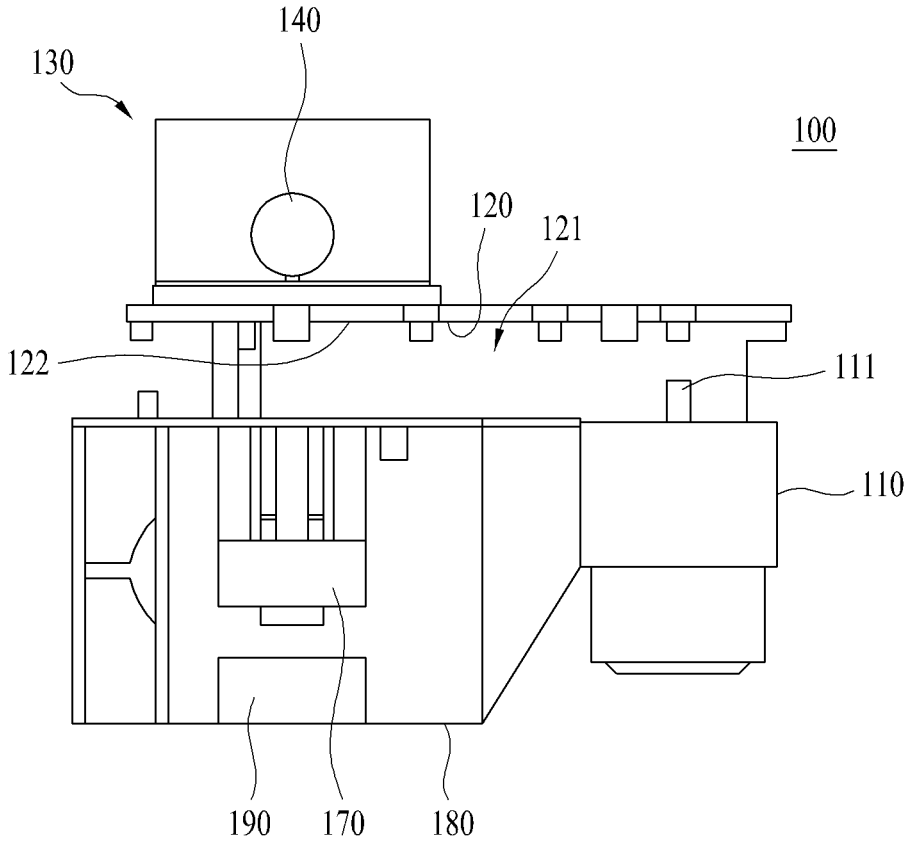
FIG. 1 is a conceptual view showing a plasma lighting system according to one embodiment of the present invention.
Figure 2:
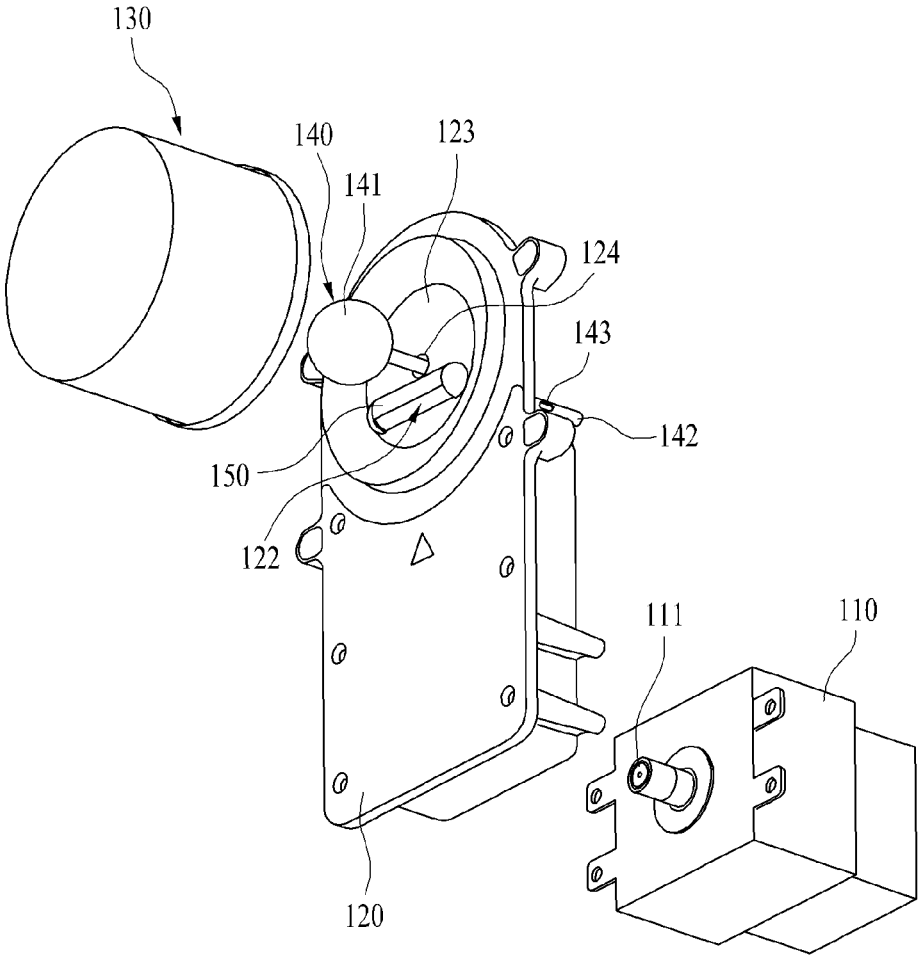
FIG. 2 is an exploded perspective view showing the plasma lighting system according to the embodiment of the present invention.

FIG. 1 is a conceptual view showing a plasma lighting system according to one embodiment of the present invention, and FIG. 2 is an exploded perspective view showing the plasma lighting system according to the embodiment of the present invention.

Referring to FIGS. 1 and 2, the plasma lighting system, designated by reference numeral 100, includes a magnetron 110, a waveguide 120 and a bulb 140. In addition, the plasma lighting system 100 may include a resonator 130 surrounding the bulb 140 and a drive unit 170 (e.g., a motor) to rotate the bulb 140.

In addition, the plasma lighting system 100 may include a housing 180 defining an external appearance of the plasma lighting system 100. The drive unit 170 and/or the magnetron 110 may be received in the housing 180.

Hereinafter, the respective constituent elements of the plasma lighting system 100 will be described in detail.

The magnetron 110 serves to generate microwaves having a predetermined frequency. In addition, a high voltage generator may be formed integrally with or separately from the magnetron 110.

The high voltage generator generates a high voltage. As the high voltage generated by the high voltage generator is applied to the magnetron 110, the magnetron 110 generates microwaves having a radio frequency.

The waveguide 120 includes a waveguide space 121 for guidance of the microwaves generated by the magnetron 110, and an opening 122 for transmission of the microwaves to the resonator 130.

An antenna unit 111 of the magnetron 110 may be inserted into the waveguide space 121. The microwaves are guided through the waveguide space 121, and thereafter transmitted to the interior of the resonator 130 through the opening 122.

The resonator 130 creates a resonance mode by preventing outward discharge of the introduced microwaves. The resonator 130 defines a resonance space. The resonator 130 may function to generate a strong electric field by exciting the microwaves.

In one embodiment, the resonator 130 may have a mesh form.

In addition, to allow the microwaves to be introduced into the resonator 130 only through the opening 122, the resonator 130 may be mounted to surround the opening 122 of the waveguide 120 and the bulb 140.

A reflective member 150 may be mounted at the opening 122 of the waveguide 120 to surround a portion of the opening 122.

More specifically, the reflective member 150 may be mounted at a predetermined region 123 of the waveguide 120 having the opening 122. The bulb 140 may penetrate the predetermined region 123 to thereby be connected to the motor 170. The predetermined region 123 may be surrounded by the resonator 130. The predetermined region 123 has an insertion hole 124 for insertion of the rotating shaft 142 of the bulb 140.

Meanwhile, the reflective member 150 functions to guide the microwaves to be introduced into the resonator 130 through the opening 122.

In addition, the reflective member 150 may function to reflect the microwaves introduced into the resonator 130 toward the bulb 140, in order to concentrate an electric field on the bulb 140.

The bulb 140, in which a light emitting material is received, may be placed within the resonator 130, and a rotating shaft 142 of the bulb 140 may be coupled to the motor 170 as described above.

Rotating the bulb 140 via the motor 170 may prevent generation of a hot spot or concentration of an electric field on a specific region of the bulb 140.

The bulb 140 may include a spherical casing 141 in which a light emitting material is received, and the rotating shaft 142 extends from the casing 141.

In addition, a photo sensor 143 may be mounted to the rotating shaft 142. The photo sensor 143 functions to sense optical properties of light emitted from the bulb 140. More specifically, the photo sensor 143 may serve to sense optical properties of light having passed through a clearance between the rotating shaft 142 of the bulb 140 and the insertion hole 124.

The magnetron 110 is controlled by a controller 190. More specifically, the controller 190 may control ON/OFF and output power of the magnetron 110. In addition, the controller 190 may control ON/OFF and Revolutions Per Minute (RPM) of the motor 170. In addition, the controller 190 may be placed in the housing 180.

The light emission principle of the plasma lighting system 100 having the above-described configuration will be described below.

Microwaves generated in the magnetron 110 are transmitted to the resonator 130 through the waveguide 120.

Then, as the microwaves introduced into the resonator 130 are resonated in the resonator 130, the light emitting material in the bulb 140 is excited.

In this case, the light emitting material received in the bulb 140 generates light via conversion thereof into plasma, and the light is emitted outward of the resonator 130.

Meanwhile, the plasma lighting system 100 may further include a reflective member (not shown) to adjust the direction of light emitted from the bulb 140 and to guide the light outward of the resonator 130. The reflective member may be a semi-spherical shade.

Figure 3:
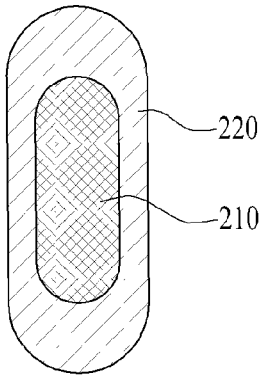
FIG. 3 is a conceptual view showing a constituent metallic material of the plasma lighting system according to one embodiment of the present invention.

FIG. 3 is a conceptual view showing a constituent metallic material of the plasma lighting system according to one embodiment of the present invention.

The bulb 140 receives a dose for generation of light under the influence of microwaves and at least one metallic material 210 for discharge (generation) of thermal electrons. In addition, the bulb 140 is filled with an inert gas such as argon (Ar).

In this specification, the term "dose" represents a light emitting material that emits light by being excited by microwaves. The dose and the metallic material 210 are received in the casing 141 of the bulb 140. The dose may include sulfur.

Upon an initial light-on condition, sulfur in the bulb 140 is present in a solid state. In this case, microwaves generated by the magnetron 110 may be applied to the bulb 140. Electrons are discharged from argon, and acceleration and collision of the electrons occur as an electric field intensity is increased. Thereafter, as sulfur is converted into plasma via evaporation thereof, a light-on condition is achieved.

The present invention provides a plasma lighting system that permits a relatively instantaneous light-on condition immediately after a light-off condition.

In a conventional plasma lighting system, the interior of a bulb remains in a high pressure state immediately after a light-off condition. In this case, sulfur in the bulb 140 is present in a gas state. In addition, argon returns to a state before the discharge of electrons. More specifically, the interior of the bulb 140 remains in a high temperature and high pressure state for a predetermined time immediately after a light-off condition. Therefore, reduction in the pressure of the bulb 140 or a change in the electric field intensity is required to implement a light-on condition.

To this end, conventionally, a predetermined time (for example, 5 minutes) has been required to reduce the internal pressure of the bulb 140 below a given level via cooling. That is, there is a need for a predetermined time taken until sulfur and argon in the bulb 140 return to a state before an initial light-on condition.

Meanwhile, the metallic material 210 may function to reduce an electric field intensity required for electric discharge by discharging thermal electrons. More specifically, the metallic material 210 generates thermal electrons even after a light-off condition of the plasma lighting system 100, enabling electric discharge. That is, the metallic material 210 functions to discharge thermal electrons in a high temperature and high pressure state upon a light-on condition after a light-off condition.

Here, a time taken until a light-on condition after a light-off condition of the plasma lighting system 100 may be 5 minutes or less. Preferably, a time taken until a light-on condition after a light-off condition of the plasma lighting system 100 may be 3 minutes or less. In addition, sulfur may be in a vapor state when the plasma lighting system 100 is again re-lit. That is, even when sulfur is in a vapor state after a light-off condition, a light-on condition may be implemented again without standby time by the metallic material 210.

In addition, the metallic material 210 functions to enable electric discharge in the bulb 140 that remains in a high pressure state. In particular, an instantaneous light-on condition may be accomplished without an increase in the output of microwaves of the plasma lighting system 100.

The metallic material 210 may include one or more of various metals capable of generating thermal electrons even in a high pressure state.

In one embodiment, the metallic material 210 may include at least one selected from the group consisting of tungsten (W), tantalum (Ta), molybdenum (Mo), rhenium (Re), lanthanum hexaboride ($LaB_6$), and cerium hexaboride ($CeB_6$).

Meanwhile, restriction of reaction between the metallic material 210 and the dose may be important.

More specifically, when the metallic material 210 and the dose react with each other, reduction of a flux due to generation of a compound and damage to the bulb 140 or deterioration in the external appearance of the bulb 140 due to the increased surface temperature of the bulb 140 may occur.

To prevent these problems, the metallic material 210 may be surrounded by an insulation capsule 220. That is, the insulation capsule 220 may prevent reaction between the metallic material 210 and the dose.

In addition, the insulation capsule 220 may surround the metallic material 210, and the metallic material 210 may be sealed in a vacuum state within the insulation capsule 220.

In addition, the insulation capsule 220 may be formed of quartz or ceramic.

Meanwhile, to restrict reaction between the metallic material 210 and the dose, the bulb 140 may be additionally filled with at least one metal halide.

More specifically, the bulb 140 may receive sulfur for generation of light using microwaves, the metallic material 210 for generation of thermal electrons, and the metal halide.

In addition, the dose may include a main dose including sulfur and an additive dose including at least one metal halide.

The additive dose may include a compound of a metal and a halogen.

In one embodiment, the metal may be one selected from the group consisting of scandium (Sc), sodium (Na), titanium (Ti), indium (In), dysprosium (Dy), holmium (Ho), thulium (Tm), potassium (K), calcium (Ca), tin (Sn), antimony (Sb), strontium (Sr), and aluminum (Al).

In addition, the halogen may be one selected from the group consisting of chlorine (Cl), bromine (Br), iodine (I), and astatine (At).

Figure 4:
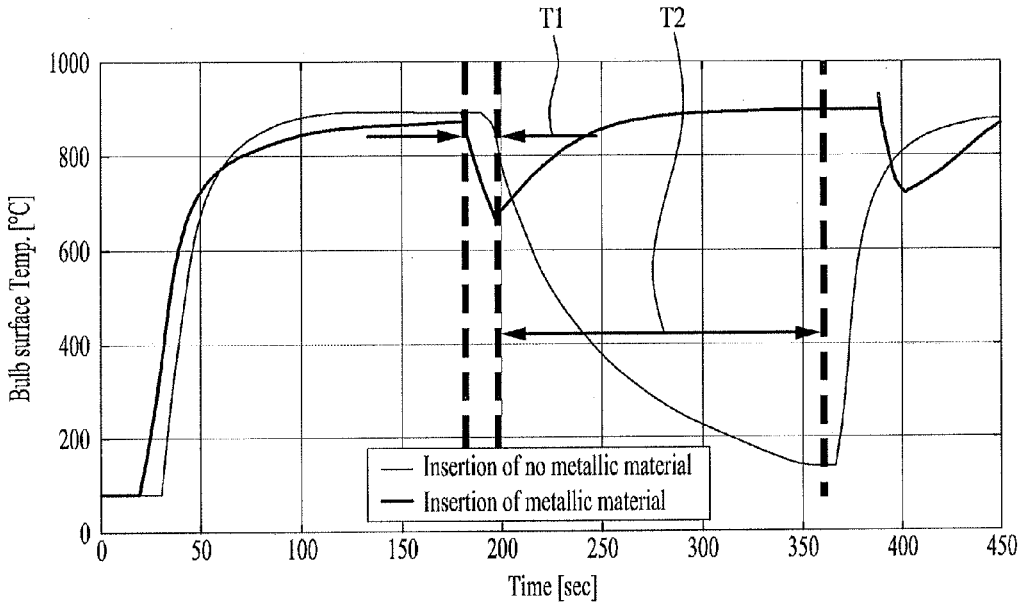
FIGS. 4 and 5 show simulation results explaining effects of the plasma lighting system according to the present invention.
Figure 5:
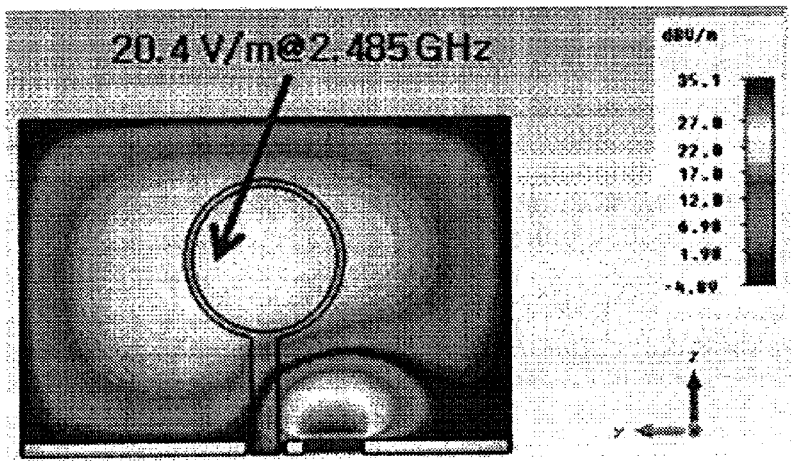
Figure 5:
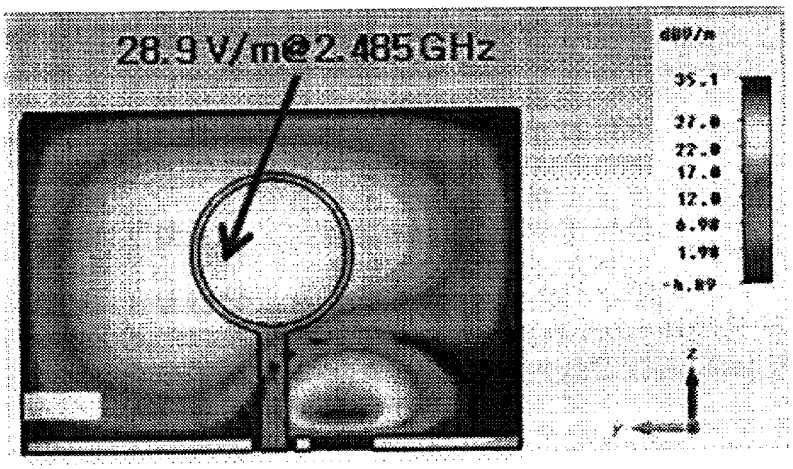

FIGS. 4 and 5 show simulation results explaining effects of the plasma lighting system 100 according to the present invention.

FIG. 4 is a graph showing time taken until a light-on condition based on insertion of the metallic material 210.

Reference numeral T1 designates time taken until a light-on condition in a case in which the metallic material is inserted into the bulb 140, and reference numeral T2 designates time taken until a light-on condition in a case in which no metallic material is inserted into the bulb 140.

Referring to FIG. 4, it can be confirmed that the time taken until a light-on condition after a light-off condition is considerably reduced in a case in which the metallic material is inserted into the bulb 140.

That is, as the metallic material generates thermal electrons in the bulb that remains in a high pressure state after a light-off condition, electric discharge is possible and thus a light-on condition of the plasma lighting system is possible.

FIG. 5(*a*) shows the distribution and intensity of an electric field in the bulb in which no metallic material is received. In addition, FIG. 5(*b*) shows the distribution and intensity of an electric field in the bulb in which the metallic material is received.

Referring to FIG. 5(*a*), in a case in which no metallic material is received in the bulb, an electric field is relatively uniformly distributed in the bulb.

In contrast, referring to FIG. 5(*b*), in a case in which the metallic material is received in the bulb, an electric field is concentrated on the metallic material inserted into in the bulb, thus causing an electric field intensity required for electric discharge. In addition, filling the bulb with the metallic material may increase the intensity of an electric field in the bulb.

In addition, a small quantity of thermal electrons generated by the metallic material may also cause an electric field to be concentrated on the metallic material, thus enabling an instantaneous initial light-on condition.

As is apparent from the above description, a plasma lighting system according to one embodiment of the present invention has the following effects.

The plasma lighting system includes a metallic material received in a bulb. The metallic material functions to reduce an electric field intensity required for electric discharge by discharging thermal electrons.

Accordingly, the plasma lighting system may reduce time taken until a light-on condition after a light-off condition. More specifically, as electric discharge occurs even in a state in which the interior of the bulb remains in a high pressure state, an instantaneous light-on condition is possible. In addition, cooling to reduce the internal pressure of the bulb after a light-off condition is unnecessary.

In addition, as an electric field in the interior of the bulb is concentrated on the metallic material, it is possible to achieve an electric field intensity required for electric discharge.

In addition, it is possible to achieve a luminous flux of a given level or more and to maintain a desired luminous efficacy by restricting reaction of the metallic material and a main dose (for example, sulfur).

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A plasma lighting system comprising:

a magnetron configured to generate microwaves; and a bulb configured to emit light, the bulb including:

a dose located in the bulb for generation of light under the influence of the microwaves; and at least one metallic material located in the bulb to reduce an electric field intensity required for electric discharge by discharging thermal electrons, wherein the metallic material is surrounded by an insulation capsule formed of ceramic and sealed in a vacuum state within the insulation capsule to prevent the metallic material and the dose from reacting.

2. The system according to claim 1, wherein the metallic material includes at least one selected from the group consisting of tungsten (W), tantalum (Ta), molybdenum (Mo), rhenium (Re), lanthanum hexaboride ($LaB_6$), and cerium hexaboride ($CeB_6$).

3. The system according to claim 1, wherein the dose includes a main dose including sulfur and an additive dose including a metal halide, and wherein the additive dose includes at least one of compounds of a metal selected from the group consisting of scandium (Sc), sodium (Na), titanium (Ti), indium (In), dysprosium (Dy), holmium (Ho), thulium (Tm), potassium (K), calcium (Ca), tin (Sn), antimony (Sb), strontium (Sr) and aluminum (Al) and a halogen selected from the group consisting of chlorine (Cl), bromine (Br), iodine (I) and astatine (At).

4. The system according to claim 1, wherein the metallic material discharges thermal electrons when the dose in the bulb is in a vapor state.

5. A plasma lighting system comprising:

a magnetron configured to generate microwaves;

a bulb configured to emit light, the bulb including:

a dose located in the bulb for generation of light under the influence of the microwaves;

an inert gas; and at least one metallic material located in the bulb to reduce an electric field intensity for electric discharge by discharging thermal electrons;

a waveguide configured to guide the microwaves generated by the magnetron into the bulb; and a resonator surrounding the bulb, wherein the metallic material is surrounded by an insulation capsule formed of ceramic and sealed in a vacuum state within the insulation capsule to prevent the metallic material and the dose from reacting.

6. The system according to claim 5, wherein the dose includes sulfur, and wherein the inert gas includes argon (Ar).

7. The system according to claim 5, wherein the metallic material includes at least one selected from the group consisting of tungsten (W), tantalum (Ta), molybdenum (Mo), rhenium (Re), lanthanum hexaboride ($LaB_6$) and cerium hexaboride ($CeB_6$).

8. The system according to claim 5, wherein the metallic material discharges thermal electrons when the dose in the bulb is in a vapor state.

9. A plasma lighting system comprising:

a magnetron configured to generate microwaves;

a bulb configured to emit light, the bulb including:

a dose located in the bulb for generation of light under the influence of the microwaves;

an inert gas; and at least one metallic material located in the bulb to reduce an electric field intensity required for electric discharge by discharging thermal electrons;

a waveguide configured to guide the microwaves generated by the magnetron into the bulb; and a controller configured to control the magnetron, wherein the metallic material is surrounded by an insulation capsule formed of ceramic and sealed in a vacuum state within the insulation capsule to prevent the metallic material and the dose from reacting.

10. The system according to claim 9, wherein the dose includes sulfur, and wherein the inert gas includes argon (Ar).

11. The system according to claim 10, wherein the metallic material discharges thermal electrons when the plasma lighting system is again in a light-on condition after a light-off condition.

12. The system according to claim 11, wherein a time until a light-on condition after a light-off condition is 5 minutes or less.

13. The system according to claim 11, wherein the sulfur is in a vapor state when the plasma lighting system is again in a light-on condition.

14. The system according to claim 9, wherein the metallic material includes at least one selected from the group consisting of tungsten (W), tantalum (Ta), molybdenum (Mo), rhenium (Re), lanthanum hexaboride ($LaB_6$) and cerium hexaboride ($CeB_6$).

* * * * *